US005669087A

United States Patent [19]

Wells et al.

[11] Patent Number: 5,669,087

[45] Date of Patent: Sep. 23, 1997

[54] LACING WIRE ZONED MATTRESS

[75] Inventors: Thomas J. Wells, Carthage, Mo.; William L. Ayers, IV, Duluth, Ga.

[73] Assignee: L&P Property Management Company, Chicago, Ill.

[21] Appl. No.: 631,841

[22] Filed: Apr. 10, 1996

[51] Int. Cl.[6] ..... A47C 23/02

[52] U.S. Cl. ..... 5/269; 5/267; 5/716; 267/91

[58] Field of Search ..... 5/716, 719, 721, 5/269, 267; 267/91

[56] References Cited

U.S. PATENT DOCUMENTS

| | | | |
|---|---|---|---|
| 426,022 | 4/1890 | Jeffery | 5/269 |
| 554,822 | 2/1896 | Ivens, Jr. | 5/269 |
| 2,033,841 | 3/1936 | Maddux | 5/269 |
| 2,120,093 | 6/1938 | Foster . | |
| 2,226,165 | 12/1940 | Fischer . | |
| 2,265,426 | 12/1941 | Foster | 5/269 |
| 2,688,757 | 9/1954 | Bronstien | 5/269 |
| 2,910,114 | 10/1959 | Levine . | |
| 3,089,154 | 5/1963 | Boyles | 5/269 |
| 3,735,431 | 5/1973 | Zocco . | |
| 4,052,760 | 10/1977 | Golembeck et al. . | |
| 4,122,566 | 10/1978 | Yates . | |
| 4,180,877 | 1/1980 | Higgins . | |
| 4,679,266 | 7/1987 | Kraft . | |
| 4,918,773 | 4/1990 | Scott . | |
| 4,972,536 | 11/1990 | Scott . | |
| 5,325,553 | 7/1994 | Ripley et al. . | |

FOREIGN PATENT DOCUMENTS

| | | | |
|---|---|---|---|
| 12088 | of 1914 | United Kingdom | 5/269 |

*Primary Examiner*—Flemming Saether
*Assistant Examiner*—Tuyet-Phuong Pham
*Attorney, Agent, or Firm*—Wood, Herron & Evans, L.L.P.

[57] ABSTRACT

A mattress spring core having a plurality of zones of differing firmnesses due to different characteristics of helical lacing connectors within the particular zones. The spring core has a plurality of identical coil springs arranged in side-by-side transversely extending rows and columns. The coil springs are connected together at the upper and lower ends of the springs with helical lacing connectors which encircle a portion of the upper and lower faces of the springs. The helical lacing connectors may be of a heavier gauge wire in one or more zones of the mattress spring core thus causing that particular zone to be of an increased firmness relative to the other zones of the mattress. Alternatively, the helical lacing connectors within a zone may comprise two or more co-axial lacing wires to impart greater strength or rigidity to one or more zones of the mattress.

21 Claims, 1 Drawing Sheet

LACING WIRE ZONED MATTRESS

FIELD OF INVENTION

The present invention relates to bedding mattresses and more particularly to the spring interior of a bedding mattress.

DESCRIPTION OF THE PRIOR ART

Conventional mattresses and box springs are of uniform firmness along their lengths and widths. The interior spring core construction of a typical mattress consists of a plurality of rows and columns of identically configured coil springs. The coil springs are held together in the upper and lower planes of the coil springs by a plurality of individual clips or helical lacing wires. If helical lacing wires are used to connect the coil springs, the helical lacing wires are of identical construction and extend parallel to each other connecting adjacent rows or columns of coil springs. This uniform construction of the interior spring core of the mattress results in a uniform firmness throughout the entire length and width of the mattress.

When a person reclines on top of a mattress in a conventional manner pressure is applied unevenly to the top surface of the mattress. This uneven pressure or uneven loading of the surface is a consequence of uneven weight distribution of a person reclining on the surface of the mattress. As is well known the heaviest portion of the body is located approximately midway along the length of the body and consequently a person reclining on top of a mattress tends to cause the mattress to deflect or sag to a greater extent in the lengthwise center of the mattress than at the ends of the mattress. This uneven deflection in turn results in a person reclining on top of the mattress with an unnatural or uncomfortable misalignment imparted to his or her spine due to the middle portion of the body being lower than the legs or upper portion of the body. To counteract this uneven deflection of a mattress when a person is reclining on top of the mattress, one proposal has been to reinforce or make firmer selected sections such as the middle third section of a mattress. Increasing the firmness of selected sections of the mattress has been accomplished by increasing the number or density of springs in the center section of the mattress, using different or firmer springs in the center section of the mattress, or adding additional structure such as foam blocks to the center section of the mattress to reinforce that section and make it firmer than the two end sections of the mattress.

One patent which utilizes heavier coil springs in the central third of the longitudinal dimension of the mattress is U.S. Pat. No. 4,052,760 which discloses two different gauge coil springs making up a mattress coil spring assembly, the coil springs of heavier gauge wire being located in the central longitudinal section of the mattress to increase the firmness of the middle portion of the mattress.

Another patent which discloses differing zones of firmness in the spring core of a mattress due to differing coil springs within the spring core is U.S. Pat. No. 4,679,226. In this patent, zones of a mattress spring core of differing firmness are created by the installation of coil springs of differing firmnesses in multiple longitudinally extending zones of the mattress. However, one problem with this type of mattress and all other mattresses which are characterized by multiple zones of differing firmnesses attributable to differing characteristics of the coil springs which make up the spring core of the mattress is that such a multiple zoned mattress has been relatively expensive to manufacture, primarily because of the difficulty of automating the manufacture and particularly the assembly of such mattress or spring core assemblies.

U.S. Pat. No. 4,972,536 issued to the assignee of the present invention, also discloses a mattress having differing zones of firmness due to differing characteristics of the springs in those zones. The springs in the different zones may be made of differing gauge wire or of differing heights to alter the firmness in the different zones of the mattress. However, these springs are not conventional coil springs but rather continuous bands of springs, the differing bands of springs in the differing zones being of a different gauge wire and therefore a different rigidity of springs.

Another concept used to impart differing degrees of firmness on different longitudinal zones of a mattress is disclosed in U.S. Pat. No. 4,918,773 also assigned to the assignee of the present invention. In this mattress the differing zones of firmness are attributable to a plurality of posture rods which extend through interlaced portions of a plurality of pairs of interlaced coils of the spring interior. Again the springs are not individual coil springs but rather are continuous bands of springs. The firmness of any particular zone can be altered by increasing or decreasing the number of posture rods in that particular zone or altering the characteristics of the posture rods. Increasing the firmness of one or more zones of a mattress by posture rods as in this patent requires additional elements, thereby increasing the cost and time needed for assembly.

It has therefore been an objective of the present invention to provide an improved method and apparatus for imparting differing firmnesses to differing longitudinal sections or zones of a mattress spring core.

It has been another objective of the present invention to provide an improved method and apparatus for increasing the firmness of selected longitudinal zones of a mattress without altering the coil springs which comprise the core of the mattress.

It has been a further objective of the present invention to provide a method and apparatus for increasing the firmness of selected longitudinal zones of a mattress spring core in an economical and cost efficient manner.

SUMMARY OF THE INVENTION

The invention of this application which accomplishes these objectives comprises a bedding mattress spring core comprising a plurality of springs connected together with helical lacing connectors. The spring core is separated into a plurality of regions, each region being of differing firmness due to different characteristics of the helical lacing connectors within that region of the spring core. The springs which make up the spring core are identical in all regions of the spring core and in no way contribute to the differing firmnesses of the regions. Each spring has an upper face in an upper plane and a lower face in a lower plane with a plurality of helical turns or revolutions between the upper and lower faces of the spring. The springs may be conventional coil springs or continuous bands of springs but in either case are arranged in side-by-side rows and columns. Adjacent rows of springs are connected together by helical lacing connectors in the upper and lower planes such that the helical lacing connectors encircle a portion of the upper and lower faces of the springs, The springs of the spring core are identical throughout the entire width and length of the spring core. The helical lacing connectors of the spring core are of differing characteristics within the different regions of the spring core. These differing characteristics impart a differing firmness to the different regions or zones of the mattress spring core.

In one embodiment of the present invention the helical lacing connectors in selected longitudinally extending regions or zones of the mattress spring core are of a heavier gauge wire than the helical lacing connectors in other longitudinally extending regions or zones of the mattress spring core. The longitudinally extending zones of the mattress spring core having the heavier gauge helical lacing connectors are of a greater firmness or rigidity than the longitudinally extending zones of the mattress spring core having helical lacing connectors of a lesser gauge. The spring core can be divided up into any number of longitudinally extending zones or regions. However, the helical lacing connectors in a particular longitudinally extending zone must be identical so that the longitudinally extending zone has uniform firmness or rigidity. Any number of these longitudinally extending zones in which increased firmness is desired in the zone may be constructed with helical lacing connectors of a heavier gauge wire than the helical lacing connectors in the other longitudinally extending zones of the spring core.

In a second embodiment of the present invention the helical lacing connectors in selected longitudinally extending regions or zones of the spring core in which increased firmness or rigidity is desired comprise multiple co-axial helical lacing connector wires. The increased rigidity in such zones of the mattress spring core is due solely to the multiple co-axial helical lacing wires rather than due to springs themselves. The remaining zones of the mattress spring core have helical lacing connectors comprising single helical lacing wires, as is conventional. The spring core may be divided into any number of zones oriented either longitudinally or transversely, selected of those zones being of increased firmness or rigidity due to the characteristics of the helical lacing connectors.

Another embodiment of the present invention comprises a mattress spring core having multiple longitudinally extending regions or zones of differing firmnesses in which the zones of increased firmness have helical lacing connectors comprising multiple co-axial helical lacing connectors of a heavier gauge than the other helical lacing connectors. This embodiment of the spring core utilizes helical lacing connectors having characteristics of the helical lacing connectors of each of the other embodiments: 1) being of a heavier gauge and 2) comprising multiple co-axial helical lacing connectors.

Due to the different characteristics of the helical lacing connectors in different zones of the mattress spring core a spring core having different degrees of firmness may be constructed without altering the springs of the spring core. Maintaining uniform springs throughout the spring core makes automation of the manufacture and assembly of the mattress spring cores easier and more cost efficient.

These and other objects and advantages of this invention will become more readily apparent from the following description of the drawings in which:

DESCRIPTION OF THE PREFERRED EMBODIMENT

Figure 1:
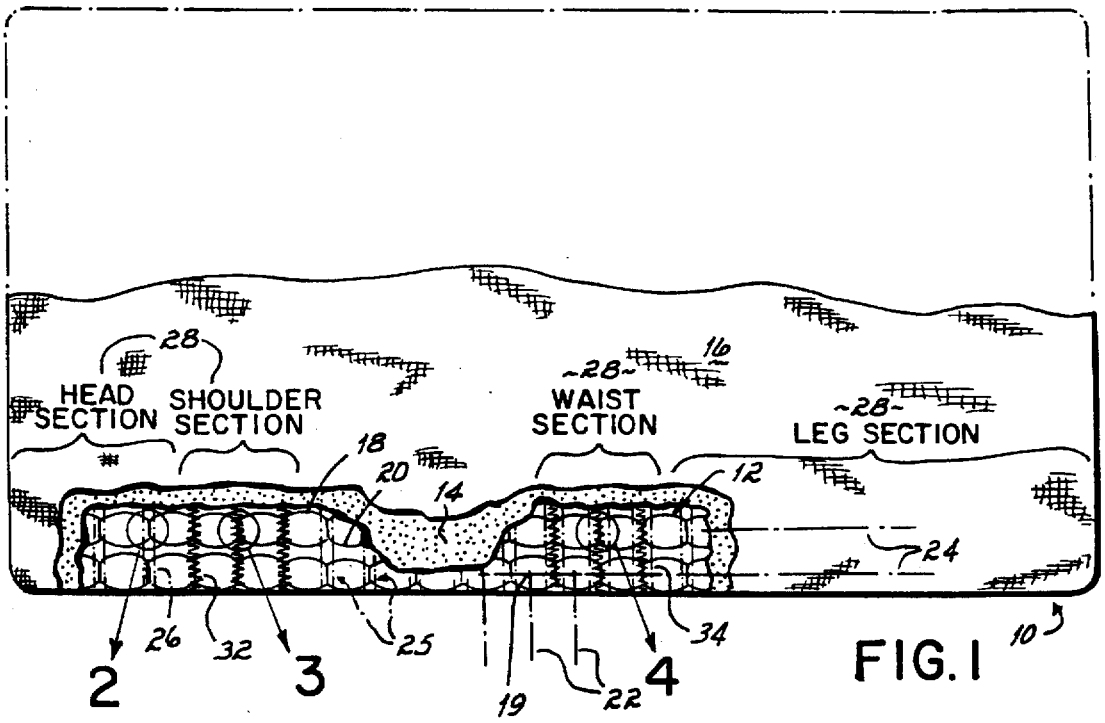
FIG. 1 is a top plan view, partially broken away of a mattress incorporating the invention of this application.

Referring to the drawings, and particularly to FIG. 1 there is illustrated a bedding mattress having a plurality of longitudinally extending zones of differing firmnesses. The bedding mattress 10 comprises a spring core 12, a padding overlay 14 which covers the top surface of the spring core 12 and a fabric cover 16 enclosing the spring core 12 and padding overlay 14.

The spring core 12 which is the subject of this invention comprises a plurality of helical coil springs 18 each having a central spiral portion defining a central spring axis 19 and terminating at opposing ends in upper and lower end turns 20. The upper and lower end turns 20 of the coil springs 18 are disposed in planes substantially perpendicular to the spring axis 19. The coil springs 18 are arranged in side-by-side transversely extending rows 22 and longitudinally extending columns 24. As seen in FIG. 1, adjacent rows 22 of coil springs 18 are connected to each other at the upper and lower end turns 20 of the coil springs 18 by transversely extending helical lacing connectors 25 arranged in the upper and lower planes. The helical lacing connectors 25 encircle confronting or overlapped portions of the end turns 20 of adjacent rows 22 of coil springs 18, functioning to bind the end turns 20 of the coil springs 18 together in both the upper and lower planes of the coil spring core 12.

As seen in FIG. 1, the mattress 10 is divided into a plurality of longitudinally extending regions or zones 28, each zone being of a different firmness due to the different characteristics of the helical lacing connectors within that particular zone or region. The springs throughout the spring core are identical and do not vary from zone to zone, However, The helical lacing connectors vary from zone to zone and have identical characteristics within a zone. All the helical lacing connectors within a zone are identical.

As seen in FIG. 1, the helical lacing connectors extend transversely across the spring core 12 thus dividing the spring core 12 into a plurality of longitudinally extending zones 28, each longitudinally extending zone 28 having its own unique lacing connectors within the zone. Although not shown in the drawings, the helical lacing connectors within a particular zone could extend longitudinally rather than transversely thus separating the mattress spring core 12 into a plurality of transversely extending zones or regions, each transversely extending zone being of a different firmness due to the characteristics of the helical lacing connectors.

Although FIG. 1 illustrates a spring core made up of a plurality of conventional coil springs, each coil spring having an upper and lower end turn 20 disposed in upper and lower planes, the planes being perpendicular to the spring axes. The spring core 12 of the present invention may be made from conventional knotted coil springs, conventional unknotted coil springs or conventional continuous bands of springs as, for example, illustrated in U.S. Pat. No. 4,972,536. Each band is made from one continuous piece of wire and has upper and lower faces disposed in upper and lower planes of the spring core 12.

Figure 2:
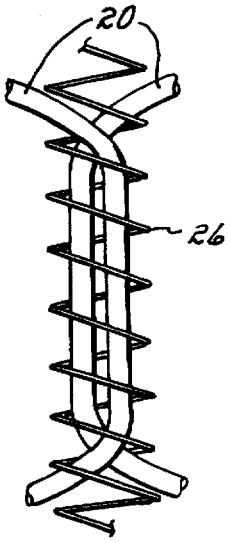
FIG. 2 is an enlarged portion of the encircled area 2 of FIG. 1 showing a conventional helical lacing connector connecting the top faces of two adjacent springs.

Illustrated in FIG. 2 is a conventional helical lacing connector 26 connecting end turns 20 of coil springs 18 of adjacent rows 22 together. The helical lacing connectors 26 depicted in FIG. 2 connect the upper end turns 20 of coil springs 18 of adjacent transversely extending rows 22 in the uppermost or head zone of the mattress as shown in FIG. 1. These helical lacing connectors 26 are of a standard gauge wire and comprise one continuous lacing wire extending across the width of the spring core 12. Such helical lacing connectors are standard in the industry and are used to make mattresses of conventional uniform firmness.

As illustrated in FIG. 1, a longitudinally extending zone of the mattress spring core 12 entitled "shoulder section" adjacent the longitudinally extending zone entitled "head section" has a plurality of transversely extending helical lacing connectors 32 of a heavier gauge wire than the helical lacing connectors 26 of the longitudinally extending zone entitled "head section" (see FIG. 2). The heavier gauge wire 32 imparts an increased firmness or rigidity to the particular zone or region of the spring core 12 utilizing such heavier gauge helical lacing connectors 32. This increased firmness to the particular zone of a mattress in which the heavier gauge lacing wire is utilized is primarily attributable to deflection of one spring causing adjacent springs to be similarly pulled and deflected downwardly by the heavier gauge lacing wire. Lesser gauge lacing wires expand to a greater degree and thus cause adjacent springs to deflect to a lesser degree when one spring is deflected.

FIG. 1 illustrates one longitudinally extending zone 28 of the mattress spring core 12 with the heavier gauge helical lacing connectors 32 in the shoulder section of the mattress. However, any number of longitudinally extending zones 28 of the mattress may be of increased rigidity due to the heavier gauge helical lacing connectors connecting adjacent rows of springs in that particular zone of the spring core. Typically, the middle section of the mattress spring core is the portion in which increased firmness is desired so as to reduce the deflection of the middle section of the spring core when a person reclines upon the mattress. The middle portion of a person's body is typically heavier than the upper and lower portions of the body so that when the person lies on a mattress of uniform firmness the middle portion of the body causes a greater deflection of the coil springs in the middle portion of the mattress and hence stresses the spine of the user reclining on top of the mattress. With helical lacing connectors of heavier gauge wire in the middle portion of the mattress the middle portion of the mattress is of increased firmness because the springs connected by the heavier gauge wire are better able to resist deflection and hence reduce the distortion of the spine of the user.

Figure 3:
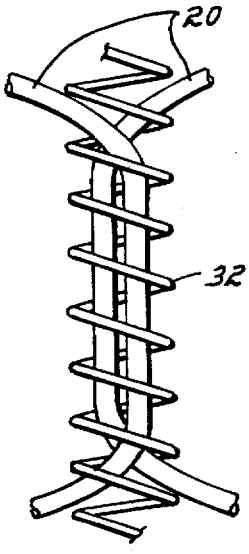
FIG. 3 is an enlarged view of the encircled area 3 of FIG. 1 showing a helical lacing connector of a heavier gauge than the helical lacing connector of FIG. 2.
Figure 4:
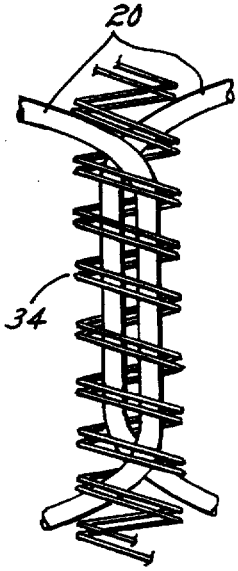
FIG. 4 is an enlarged view of the encircled area 4 of FIG. 1 showing a helical lacing connector comprising two co-axial helical lacing wires.

FIG. 4 illustrates a second embodiment of the present invention in which the helical lacing connectors comprise multiple co-axial helical lacing wires 34 in one or more longitudinally extending zones 28 of a mattress spring core 12. In this embodiment, the helical lacing connectors may comprise two or more co-axial wires 34 rather than one single wire as in the other embodiment illustrated in FIG. 3. As with the heavier gauge helical lacing connectors 32, the multiple co-axial helical lacing wires 34 impart greater firmness or rigidity to one or more longitudinally extending zones or regions of a mattress in which they are utilized to connect adjacent rows of springs. FIG. 1 illustrates helical lacing connectors comprising multiple co-axial helical lacing wires 34 in one longitudinally extending region 28 entitled "waist section". Due to the two or double co-axial helical lacing wires 34 in the "waist section" of the mattress 10, it is of greater firmness than the head and leg sections of the mattress. Again all the particular helical lacing connectors in a zone are identical to give that particular zone a uniform rigidity. As with the heavier gauge helical lacing connectors 32, any number of longitudinally extending zones 28 of a mattress spring core 12 may have multiple co-axial helical lacing wires 34 functioning as helical lacing connectors in order to impart additional firmness in those particular longitudinally extending zones 28 of the spring core 12.

A mattress spring core may have both heavier gauge helical lacing connectors in certain longitudinally extending zones of a mattress core and multiple co-axial helical lacing wires in different longitudinally extending zones of the mattress spring core in order to impart increased rigidity to those particular zones. However, the helical lacing connectors in the different longitudinally extending zones of the mattress must be of differing characteristics in order for there to be more than one degree of firmness in the mattress spring core because the springs themselves are uniform throughout the spring core. When multiple co-axial helical lacing wires are used as helical lacing connectors the co-axial wires may or may not be of a heavier gauge than the gauge of the helical lacing connectors in the other longitudinally extending regions of the mattress spring core.

While we have described a relatively few preferred embodiments of the invention, persons skilled in the art will appreciate changes and modifications which may be made without departing from the spirit of my invention. Therefore, we do not intend to be limited except by the scope of the following appended claims.

We claim:

1. A bedding mattress comprising:

a spring core having a relatively long longitudinal dimension and a relatively shorter transverse dimension, said spring core comprising a plurality of helical coil springs each having a central spiral portion defining a central spring axis and terminating at opposing ends in upper and lower end turns disposed in planes substantially perpendicular to said spring axis, said coil springs being arranged in side by side transversely extending rows, a plurality of transversely extending helical lacing connectors said coil springs being connected with each other at overlapping portions of said upper and lower end turns by said helical lacing connectors arranged in said planes such that each of said helical lacing connectors encircles said overlapped portions of said end turns of adjacent rows of said coil springs, said mattress being separated into multiple longitudinally extending regions, each of said longitudinally extending regions having at least two spaced helical lacing connectors therein, said longitudinally extending regions being of differing firmnesses, said differing firmnesses being attributable to differing physical characteristics of said helical lacing connectors, padding overlying said end turns of said springs; and a fabric cover enclosing said spring core and said padding.

2. A bedding mattress spring core having a relatively long longitudinal dimension and a relatively shorter transverse dimension, said spring core comprising a plurality of helical coil springs each having a central spiral portion defining a central spring axis and terminating at opposing ends in upper and lower end turns disposed in planes substantially perpendicular to said spring axis, said coil springs being arranged in side by side transversely extending rows, a plurality of transversely extending helical lacing connectors, said coil springs being connected with each other at overlapped portions of said upper and lower end turns by said helical lacing connectors arranged in said planes such that each of said helical lacing connectors encircles said overlapped portions of adjacent rows of said end turns of said coil springs, said mattress being separated into multiple longitudinally extending regions, each of said longitudinally extending regions having at least two spaced helical lacing connectors therein, said longitudinally extending regions being of differing firmnesses, said differing firmnesses being attributable, at least in part, to differing physical characteristics of said helical lacing connectors.

3. A bedding mattress spring core having a relatively long longitudinal dimension and a relatively shorter transverse dimension, said spring core comprising a plurality of helical coil springs each having a central spiral portion defining a central spring axis and terminating at opposing ends in upper and lower end turns disposed in planes substantially perpendicular to said spring axis, said coil springs being arranged in side by side transversely extending rows, a plurality of transversely extending helical lacing connectors, said coil springs being connected with each other at overlapped portions of said upper and lower end turns by said helical lacing connectors arranged in said planes such that each of said helical lacing connectors encircles said overlapped portions of said end turns of adjacent rows of said coil springs, said mattress being separated into multiple longitudinally extending regions, each of said longitudinally extending regions having at least two spaced helical lacing connectors therein, said longitudinally extending regions being of differing firmnesses, said differing firmnesses being attributable to differing physical characteristics of said helical lacing connectors.

4. The bedding mattress spring core of claim 3 wherein said helical lacing connectors are formed of a heavier gauge wire in one longitudinally extending region of said spring core than the gauge of said helical lacing connectors in other longitudinally extending regions of said spring core.

5. The bedding mattress spring core of claim 3 wherein said helical lacing connectors in one longitudinally extending region of said spring core comprise multiple co-axial helical lacing connector wires, wherein said helical lacing connectors in other longitudinally extending regions of said spring core comprise one helical lacing connector wire.

6. The bedding mattress spring core of claim 3 wherein said helical lacing connectors are of a heavier gauge wire in selected longitudinally extending regions of said spring core in which increased firmness is desired than said helical lacing connectors in other longitudinally extending regions.

7. The bedding mattress spring core of claim 3 wherein said helical lacing connectors in selected longitudinally extending regions of said spring core in which increased firmness is desired comprise multiple co-axial helical lacing connector wires.

8. A bedding mattress spring core comprising a plurality of springs, each spring having an upper face in an upper plane, a lower face in a lower plane and a plurality of helical revolutions therebetween, said springs being arranged in side by side rows and columns, a plurality of helical lacing connectors lying generally in said planes, each of said helical lacing connectors extending generally parallel said rows and encircling adjacent portions of adjacent faces of adjacent rows of springs, said spring core being separated into regions of differing, firmnesses, each of said regions having therein multiple spaced helical lacing connectors, said differing firmnesses being attributable to said helical lacing connectors being of a heavier gauge wire in selected regions than the helical lacing connectors in other regions.

9. The bedding mattress spring core of claim 8 wherein said helical lacing connectors in said selected regions of said spring core further comprise multiple co-axial helical lacing connector wires.

10. The bedding mattress spring core of claim 8 wherein the helical lacing connectors are identical in a region.

11. The bedding mattress spring core of claim 10 wherein the helical lacing connectors of a region are different from the helical lacing connectors of an adjacent region.

12. A method for increasing the firmness one or more portions of a mattress spring core, which spring core comprises a plurality of springs each having an upper face disposed in an upper plane and a lower face disposed in a lower plane, said springs being arranged in transversely extending rows, and longitudinally extending columns defining a width of said spring core, which method comprises:

wrapping helical lacing connectors of a first gauge wire around portions of adjacent upper and lower faces of adjacent rows of coil springs in at least one first region of said spring core, wrapping helical lacing connectors of a second gauge wire around portions of adjacent end turns of adjacent rows of coil springs in at least one second region of said spring core, said first gauge wire being of heavier gauge than said second gauge wire so as to increase the firmness of said at least one first region relative to the firmness of said second region each of said helical lacing connectors extending from one endmost column of springs to the other endmost column of springs across the width of said spring core.

13. A method for increasing the firmness of one or more portions of a mattress spring core, which spring core comprises a plurality of coil springs each having an upper end turn disposed in an upper plane and a lower end turn disposed in a lower plane, said coil springs being arranged in transversely extending rows and longitudinally extending columns which method comprises:

wrapping helical lacing connectors of a first gauge wire around portions of end turns of adjacent rows of coil springs in at least one first region of said spring core, wrapping helical lacing connectors of a second gauge wire around portions of end turns of adjacent rows of coil springs in at least one second region of said spring core, said first gauge wire being of heavier gauge than said second gauge wire so as to increase the firmness of said at least one first region relative to the firmness of said second region, each of said helical lacing connectors connecting two adjacent rows of said coil springs and extending generally parallel said rows.

14. A method of increasing the firmness of one or more portions of a mattress spring core, which spring core comprises a plurality of coil springs, each coil spring having an upper end turn disposed in an upper plane and a lower end turn disposed in a lower plane, said coil springs being arranged in transversely extending rows and longitudinally extending columns which method comprises:

wrapping at least two first helical lacing connectors around overlapped portions of end turns of adjacent rows of coil springs in at least one first region of said spring core, wrapping at least two second helical lacing connectors around overlapped portions of end turns of adjacent rows of coil springs in at least one second region of said spring core, said first and second helical lacing connectors having different physical characteristics so as to increase the firmness of selected regions, each of said helical lacing connectors connecting two adjacent rows of coil springs and extending generally parallel said rows.

15. The method of increasing the firmness of one or more portions of a mattress spring core of claim 14 wherein said wrapping first helical lacing connectors further comprises wrapping a plurality of co-axial helical lacing wires around portions of end turns of adjacent rows of coil springs in order to increase the firmness of said at least one first region of said spring core.

16. The method of increasing the firmness of one or more portions of a mattress spring core of claim 14 wherein said wrapping first helical lacing connectors further comprises wrapping helical lacing wires of a heavier gauge wire around portions of end turns of adjacent rows of coil springs in order to increase the firmness of said at least one first region of said spring core.

17. A method of increasing the firmness of one or more portions of a mattress spring core, which spring core comprises a plurality of springs each having an upper face disposed in an upper plane and a lower face disposed in a lower plane, said springs being arranged in rows and columns, which method comprises:

wrapping helical lacing connectors of different gauge wire around portions of said upper and lower faces of adjacent rows of coil springs in different regions of said spring core, said helical lacing connectors being of identical gauge wire in each separate region of said spring core so as to increase the firmness of at least one region of said spring core, each of said helical lacing connectors encircling adjacent portions of adjacent faces of adjacent rows of coil springs.

18. The method of increasing the firmness of one or more portions of a mattress spring core of claim 17 wherein said wrapping helical lacing connectors further comprises wrapping a plurality of co-axial helical lacing wires around portions of adjacent faces of coil springs in order to increase the firmness of said at least one region of said spring core.

19. A bedding mattress spring core having a relatively long longitudinal dimension and a relatively shorter transverse dimension, said spring core comprising a plurality of helical coil springs each having a central spiral portion defining a central spring axis and terminating at opposing ends in upper and lower end turns disposed in planes substantially perpendicular to said spring axis, said coil springs being arranged in side by side transversely extending rows, a plurality of transversely extending helical lacing connectors, said coil springs being connected with each other at said upper and lower end turns by said helical lacing connectors arranged in said planes such that each of said helical lacing connectors encircles adjacent portions of said end turns of adjacent rows of said coil springs, said mattress being separated into multiple longitudinally extending regions, each of said longitudinally extending regions having at least two spaced helical lacing connectors therein, said longitudinally extending regions being of differing firmnesses, said differing firmnesses being attributable, at least in part, to said helical lacing connectors being formed of a heavier gauge wire in one longitudinally extending region of said spring core than the gauge of said helical lacing connectors in other longitudinally extending regions of said spring core.

20. A bedding mattress spring core having a relatively long longitudinal dimension and a relatively shorter transverse dimension, said spring core comprising a plurality of helical coil springs each having a central spiral portion defining a central spring axis and terminating at opposing ends in upper and lower end turns disposed in planes substantially perpendicular to said spring axis, said coil springs being arranged in side by side transversely extending rows, a plurality of transversely extending helical lacing connectors, said coil springs being connected with each other at said upper and lower end turns by said helical lacing connectors arranged in said planes such that each of said helical lacing connectors encircles adjacent portions of said end turns of said adjacent rows of said coil springs, said mattress being separated into multiple longitudinally extending regions, each of said longitudinally extending regions having at least two spaced helical lacing connectors therein, said longitudinally extending regions being of differing firmnesses, said differing firmnesses being attributable, at least in part, to said helical lacing connectors comprising multiple helical co-axial wires in one longitudinally extending region of said spring core and said helical lacing connectors comprising one helical wire in other longitudinally extending regions of said spring core.

21. A bedding mattress spring core comprising a plurality of springs, each spring having an upper face in an upper plane, a lower face in a lower plane and a plurality of helical revolutions therebetween, said springs being arranged in side by side rows and columns, a plurality of helical lacing connectors lying generally in said planes, each of said helical lacing connectors extending generally parallel said rows and encircling adjacent portions of adjacent faces of adjacent rows of springs, said spring core being separated into regions of differing, firmnesses, each of said regions having therein multiple spaced helical lacing connectors, said differing firmnesses being attributable to said helical lacing connectors comprising multiple co-axial helical lacing wires in selected regions of said spring core.

* * * * *